US007501990B2

(12) United States Patent
Stutzke

(10) Patent No.: US 7,501,990 B2
(45) Date of Patent: Mar. 10, 2009

(54) DUAL BAND SLOT ARRAY ANTENNA ABOVE GROUND PLANE

(75) Inventor: Nathan Stutzke, Louisville, CO (US)

(73) Assignee: Laird Technologies, Inc., Lincoln, NE (US)

( * ) Notice: Subject to any disclaimer, the term of this patent is extended or adjusted under 35 U.S.C. 154(b) by 113 days.

(21) Appl. No.: 11/742,926

(22) Filed: May 1, 2007

(65) Prior Publication Data

US 2008/0272973 A1 Nov. 6, 2008

(51) Int. Cl.
*H01Q 13/10* (2006.01)
*H01Q 1/38* (2006.01)

(52) U.S. Cl. ..... 343/770; 343/700 MS; 343/846

(58) Field of Classification Search ..... 343/770, 343/767, 700 MS, 846, 850, 853
See application file for complete search history.

(56) References Cited

U.S. PATENT DOCUMENTS

| | | | | |
|---|---|---|---|---|
| 4,775,866 | A * | 10/1988 | Shibata et al. | 343/700 MS |
| 6,130,648 | A * | 10/2000 | Rulf et al. | 343/770 |
| 6,225,958 | B1 * | 5/2001 | Amano et al. | 343/767 |
| 7,057,569 | B2 * | 6/2006 | Isoifovich et al. | 343/770 |
| 2008/0100511 | A1 * | 5/2008 | Stutzke | 343/700 MS |

* cited by examiner

*Primary Examiner*—Hoang V Nguyen
(74) *Attorney, Agent, or Firm*—Holland & Hart LLP

(57) ABSTRACT

A multiple frequency directional antenna is provided. The antenna includes a radiating array aligned over a ground plane. The radiating array has at least two first elongated slots and two second elongated slots. The slots have different lengths to provide different operating frequencies. On the radiating array opposite the slots is a microstrip impedance matching and diplexing feed network. Radio frequency power is supplied to the antenna via the feed network.

20 Claims, 1 Drawing Sheet

DUAL BAND SLOT ARRAY ANTENNA ABOVE GROUND PLANE

PRIORITY TO CO-PENDING APPLICATIONS

None.

RELATED PATENTS AND PATENT APPLICATION

None.

BACKGROUND

1. Field

The technology of the present application relates generally to array antennas and, and more specifically to a dual band slot array antenna residing above a ground plane.

2. Background

Directional, high gain patch antennas are currently available for various telematics uses, such as, for example, in-building wireless access points. Conventionally, these antennas operate over a single frequency. In some cases, the use requires operation over over multiple frequencies, such as, for example, dual frequency bands including, for example, frequency ranges of 2.4-2.5 GHz and 5.15-5.875 GHz.

While multiple independently operating antenna are possible, it would be preferable to use a single antenna design due to the compressed footprint normally available for the antenna. The antenna in some cases is constrained to a relatively small footprint such as, for example, a footprint of approximately 120 mm×120 mm×20 mm. Stacking patch antennas having the respective resonant frequencies of operation is problematic because the upper band frequency of operation is close to the second resonance of the lower band frequency of operation.

Against this background, it would be desirable to develop directional, high gain antenna. Still, however, there is a need in the industry for improved compact wideband directional antennas.

SUMMARY

To attain the advantages and in accordance with the purpose of the invention, as embodied and broadly described herein, a directional, high gain antenna is provided.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings, which are incorporated in and constitute a part of this specification, illustrate embodiments of the present invention, and together with the description, serve to explain the principles thereof. Like items in the drawings may be referred to using the same numerical reference.

DETAILED DESCRIPTION

Figure 1:
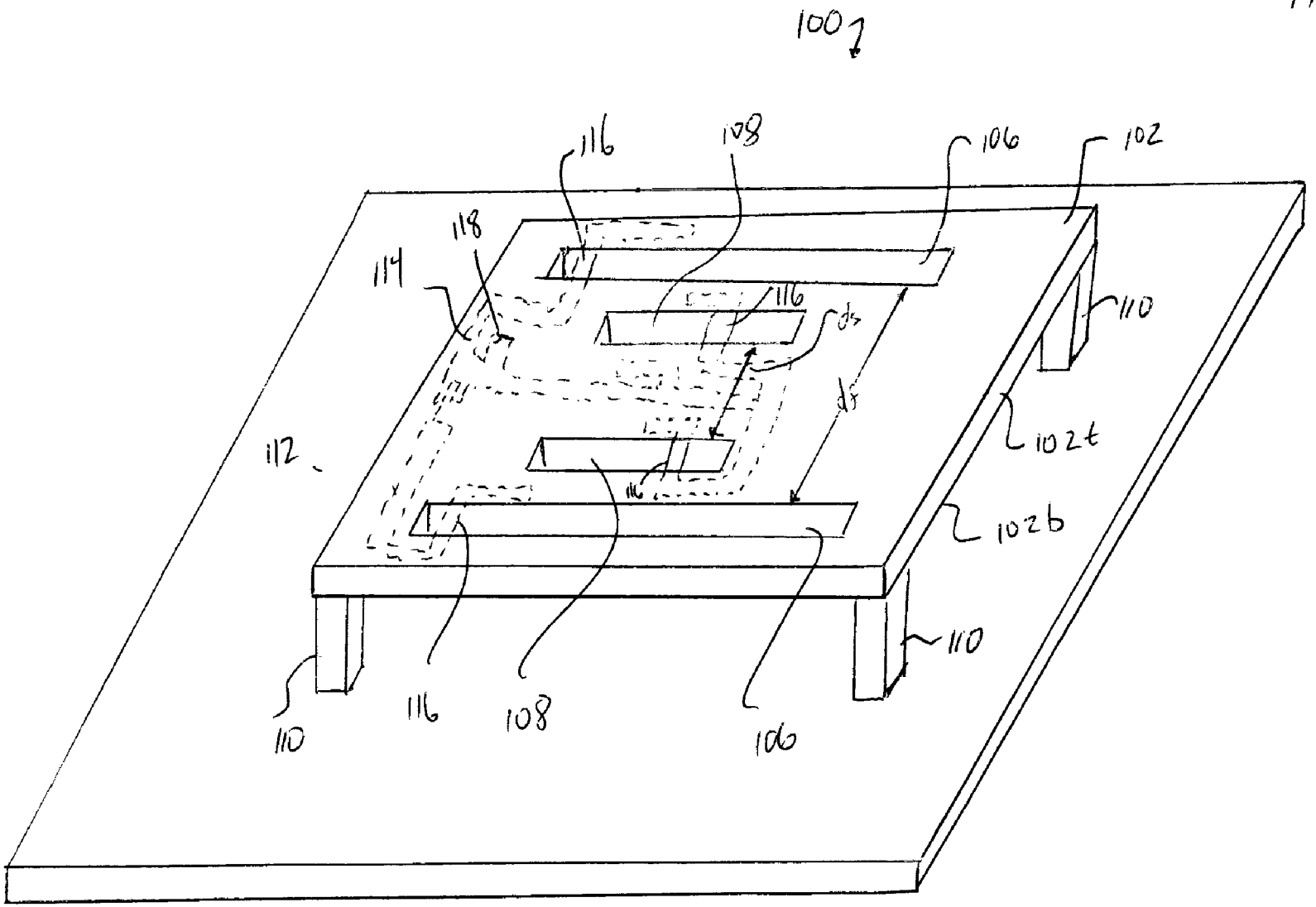
FIG. 1 is a perspective view of an antenna constructed using the technology of the present application.

The word "exemplary" is used herein to mean "serving as an example, instance, or illustration." Any embodiment described herein as "exemplary" is not necessarily to be construed as preferred or advantageous over other embodiments. Moreover, any embodiment described herein should be considered exemplary unless otherwise specifically noted. One of ordinary skill in the art will recognize on regarding the disclosure, however, other constructions and configurations are possible.

Referring to FIG. 1, an antenna 100 constructed using technology of the present invention is provided. Antenna 100 includes a radiating array 102 suspended over a ground plane 104. Radiating array 102 has a top side 102*t* and a bottom side 102*b*. Radiating array 102 comprises a plurality of first elongated slots 106 and a plurality of second elongated slots 108. The elongated slots 106, 108 provide a means for causing the radiating array 102 to radiate at multiple frequencies. Radiating array 102 is suspended over ground plane 104 using any conventional means. For example, radiating array 102 is shown supported by non-conductive posts 110. While shown with first elongated slots 106 and second elongated slots 108 arranged symmetrically about the radiating array 102, other configurations are possible including, for example, additional elongated slots to provide additional operating resonating frequencies.

First elongated slots 106 are separated by a distance df. Distance df preferably is about ½ a free-space wavelength at the frequency of operation of the array formed by first elongated slots 106. Second elongated slots 108 are separated by a distance ds.

Distance ds preferably is about ½ a free-space wavelength at the frequency of operation of the array formed by second elongated slots 108. More preferably the distances df and ds are ½ free-space wavelength at the center frequency of their respective frequency bands.

Radio frequency power is provided through a feed network 112, shown in phantom. Feed network 112 provides both impedance matching and frequency diplexing functions. Radio frequency power could be supplied using any conventional method, such as, for example, a microstrip feed line or a coaxial cable conductor. Using a cable conductor, the central conductor of the cable feed would be connected to a feed point 114 through a via 118 in radiating array 102. The outer conductor would be connected to radiating array 102. Feed network 112 would provide in phase power to the slots 106 and 108 at connections 116. Alternatively, feed network 112 could provide power with non-zero relative phase between slots 106 and 108 to squint the radiation pattern in a desired direction.

What is claimed is:

1. A directional multiple frequency antenna, comprising:

a ground plane;

a radiating array substrate arranged over the ground plane having a top side facing away from the ground plane and a bottom side facing toward the ground plane;

a plurality of first elongated slots contained in the top side of the radiating array;

a plurality of second elongated slots contained in the top side of the radiating array;

an impedance matching and diplexing network contained on the bottom side of the radiating array and connected to the plurality of first elongated slots and the plurality of second elongated slots; and a power feed connected to the impedance matching and diplexing network.

2. The antenna according to claim 1, wherein the plurality of first elongated slots and the plurality of second elongated slots are different lengths.

3. The antenna according to claim 1, wherein the impedance matching and diplexing network is a microstrip matching and diplexing network.

4. The antenna according to claim 1, wherein the plurality of first elongated slots are arranged symmetrically on the radiating array.

5. The antenna according to claim 4, wherein the plurality of second elongated slots are arranged symmetrically on the radiating array.

6. The antenna according to claim 1, wherein the plurality of first elongated slots are separated by a distance equal to ½ of an operating band free-space wavelength of the plurality of first elongated slots.

7. The antenna according to claim 6, wherein the operating band wavelength is a center frequency of the operating band of the plurality of first elongated slots.

8. The antenna according to claim 6, wherein the plurality of second elongated slots are separated by a distance equal to ½ of an operating band free space wavelength of the plurality of second elongated slots.

9. The antenna according to claim 8, wherein the operating band wavelength is a center frequency of the operating band of the plurality of second elongated slots.

10. The antenna according to claim 1, further comprising at least one non-conductive post separating the ground plane and the radiating array.

11. The antenna according to claim 1, wherein the power feed provides in-phase power.

12. A directional multiple frequency antenna, comprising:

a ground plane;

a radiating array substrate arranged over the ground plane having a top side facing away from the ground plane and a bottom side facing toward the ground plane;

means for causing the radiating array substrate to radiate at multiple frequencies;

an impedance matching and diplexing network contained on the bottom side of the radiating array and connected to the means for causing the radiating array substrate to radiate at multiple frequencies; and a power feed connected to the impedance matching and diplexing network.

13. The antenna according to claim 12, wherein the means for causing the radiating array substrate to radiate at multiple frequencies includes a plurality of elongated slots.

14. The antenna according to claim 13, wherein the plurality of elongated slots comprises at least two first elongated slots and at least two second elongated slots, wherein the first elongated slots are of a different length than the second elongated slots.

15. The antenna according to claim 14, wherein the first elongated slots are separated by a distance equal to ½ of an operating band free-space wavelength of the first elongated slots.

16. The antenna according to claim 15, wherein the operating frequency wavelength is the center frequency for an operating band of the first elongated slots.

17. The antenna according to claim 14, wherein the second elongated slots are separated by a distance equal to ½ of an operating band free-space wavelength of the second elongated slots.

18. The antenna according to claim 17, wherein the operating frequency wavelength is the center frequency for an operating band of the second elongated slots.

19. The antenna according to claim 13, wherein the plurality of elongated slots are symmetrically arranged on the radiating array.

20. The antenna according to claim 12, wherein the power feed provides in-phase power.

* * * * *